United States Patent [19]

Alexander et al.

[11] Patent Number: 4,974,773

[45] Date of Patent: Dec. 4, 1990

[54] CARTON AND BLANK THEREFOR

[75] Inventors: Kenneth G. Alexander, McLeod; Gordon E. Bower, Doncaster, both of Australia

[73] Assignees: Alexander Packaging Equipment Pty. Ltd.; Fibre Containers Pty. Limited, both of Australia

[21] Appl. No.: 340,180

[22] PCT Filed: Oct. 13, 1987

[86] PCT No.: PCT/AU87/00343

§ 371 Date: Jun. 13, 1989

§ 102(e) Date: Jun. 13, 1989

[87] PCT Pub. No.: WO88/02724

PCT Pub. Date: Apr. 21, 1988

[30] Foreign Application Priority Data

Oct. 14, 1986 [AU] Australia ..... PH8507

[51] Int. Cl.[5] ..... B65D 5/20

[52] U.S. Cl. ..... 229/164; 206/427; 229/40; 229/915; 229/DIG. 11; 53/48

[58] Field of Search ..... 229/40, 164, 169, 915, 229/DIG. 11; 206/427; 53/48, 147

[56] References Cited

U.S. PATENT DOCUMENTS

| | | | |
|---|---|---|---|
| 2,588,455 | 3/1952 | Adams | 229/164 |
| 3,014,635 | 12/1961 | Mairs et al. | 229/164 |
| 3,425,544 | 2/1969 | Ayer et al. | 229/164 |
| 3,580,475 | 5/1971 | Mobley | 229/915 |
| 3,704,823 | 12/1972 | Howe | 229/164 |
| 3,784,082 | 1/1974 | Hurlock | 229/915 |
| 4,607,750 | 8/1986 | Valenti | 206/427 |

FOREIGN PATENT DOCUMENTS

| | | | |
|---|---|---|---|
| 2805690 | 8/1979 | Fed. Rep. of Germany | 229/DIG. 11 |
| 2447862 | 10/1980 | France | 229/DIG. 11 |
| 189811 | 6/1964 | Sweden | 229/DIG. 11 |
| 1295281 | 11/1972 | United Kingdom . | |

OTHER PUBLICATIONS

"Industrial Packaging", Walter F. Friedman et al., p. 157, John Wiley & Sons, 1960.

*Primary Examiner*—Gary E. Elkins
*Attorney, Agent, or Firm*—Lane, Aitken and McCann

[57] ABSTRACT

A disposable cardboard crate for transporting and storing goods, particularly, containers of milk. The crate is a rectangular open top container and opposed end walls (25) extend above the height of the other walls (26). The end walls (25) are each folded back on themselves at the top to form a triangular box structure or girder which extends across the end and provides a horizontal ledge (24) projecting inwardly of the crate. The ledge (24) is at a height very slightly above the height of the other walls (26). The girder contributes substantially to the strength of the crate. The end walls (25) are inclined upwardly and outwardly slightly to allow the base (20) of a further crate in a stack to fit between upwardly extending portions (27) and rest on the ledges (24). The end walls have a width (X) at the top slightly less than the width (Y) at the bottom such that the base (20) of a crate overlies the other walls (26) of the crate immediately therebelow in a stack thereby contributing to the stacking strength. A blank for forming the crate is also claimed.

11 Claims, 6 Drawing Sheets

CARTON AND BLANK THEREFOR

This invention relates to cartons or crates for packaging of goods for transport and storage, and more particularly to an improved cardboard crate of the disposable type which has considerable inherent strength so as to facilitate stacking a number of packaged crates. The invention has particular utility as a crate for plastic milk containers or cardboard milk cartons but needless to say it may be used for other purposes.

Conventional crates, that is open top containers for transporting goods, in one form, are moulded of plastics material and consequently are relatively expensive to manufacture. The initial cost of manufacture is presumably offset by the fact that the crates are reusable but experience in the dairy industry, where such crates are used to transport milk containers, has shown that the on-going costs of collecting, handling and washing the plastic crates as well as replacing crates which are lost, damaged or stolen, far outweigh the advantages of a reusable crate. Thus plastic milk crates are a very expensive component in the overall cost of transporting and storing milk or milk products.

Accordingly it is an object of this invention to provide an improved disposable type crate for packaging goods, which crate has inherent stacking strength and is suitable for use as a crate for transporting milk or milk products in a manner overcoming one or more of the aforementioned disadvantages of known plastic milk crates.

The invention thus provides a blank erectable into a crate, said blank including a first panel for forming a base of the crate and a plurality of further panels which extend from said first panel for folding to form generally upright peripheral walls of the crate, characterized in that, an opposite pair of said further panels provide end walls and each end wall includes an extended portion which is foldable for forming a horizontal ledge which projects inwardly of the crate and an upward extension of the respective end walls, said ledges being below said upward extensions and providing support for the base of a like crate when stacked thereon.

Another form of the invention provides a disposable crate for packaging goods for transport and storage, said crate being a generally rectangular box having a base , peripheral walls and an open top, characterized in that, a first pair of opposed walls comprise end walls and each have an upward extension extending above the height of the other walls and a box structure or girder is arranged on the inside of each of said end walls, said box structure or girder including a horizontal ledge arranged at a height above the said height of said other walls to provide support for the base of a like crate when stacked thereon.

Figure 1:
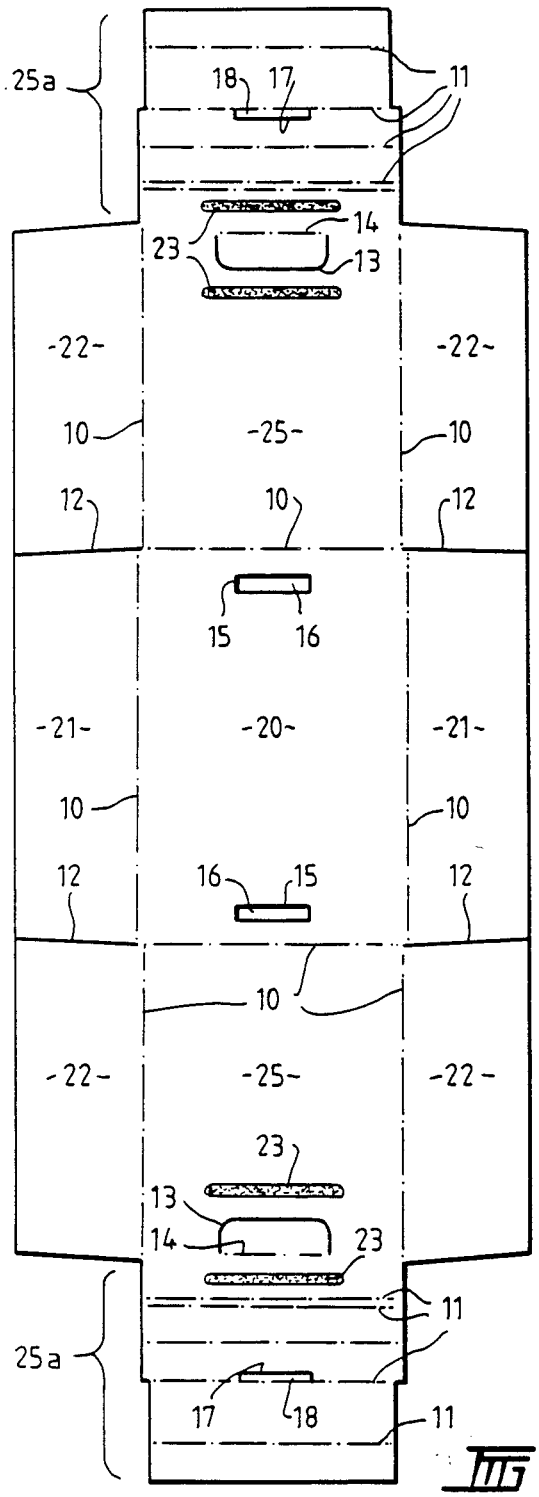
Figure 2:
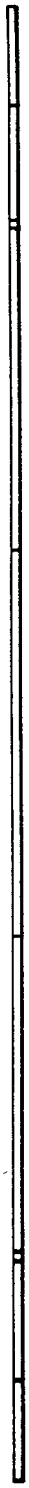
Figure 3:
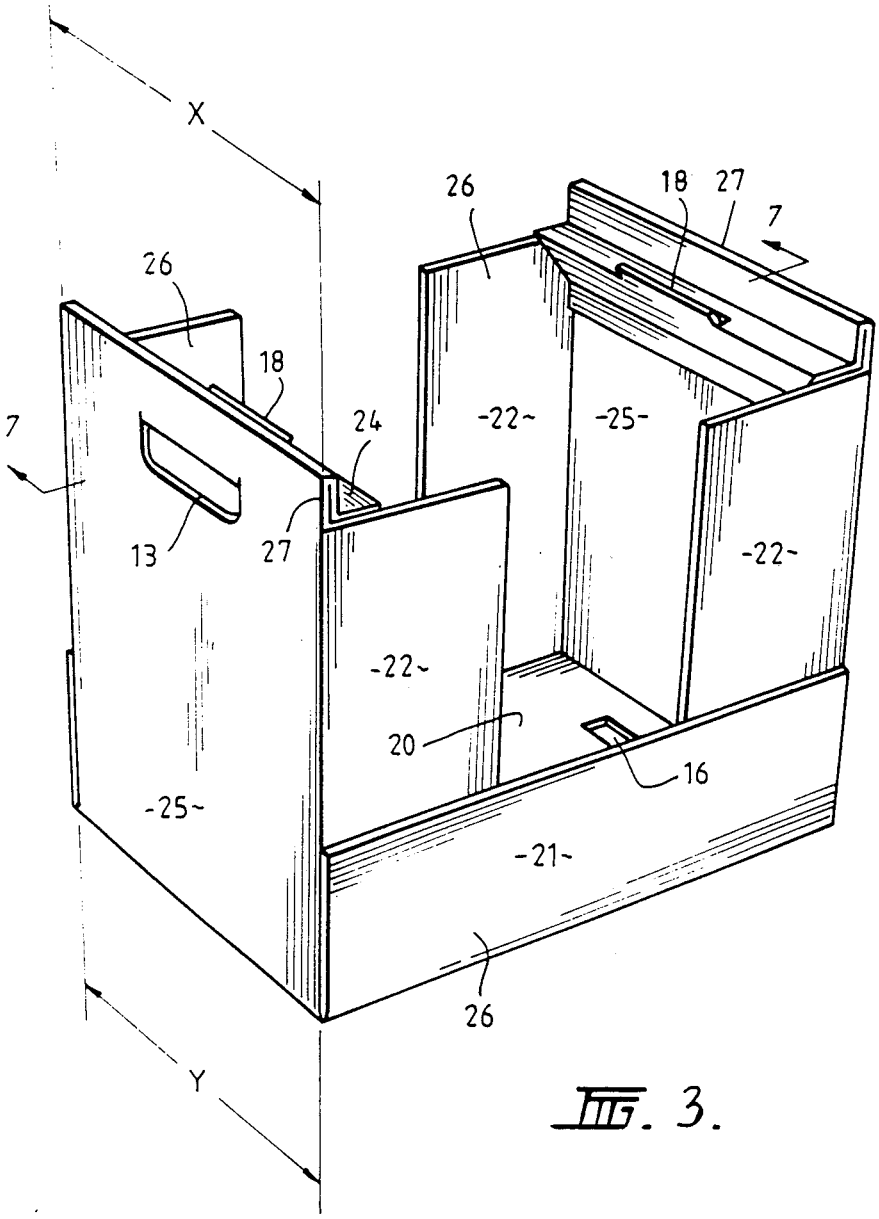
Figure 4:
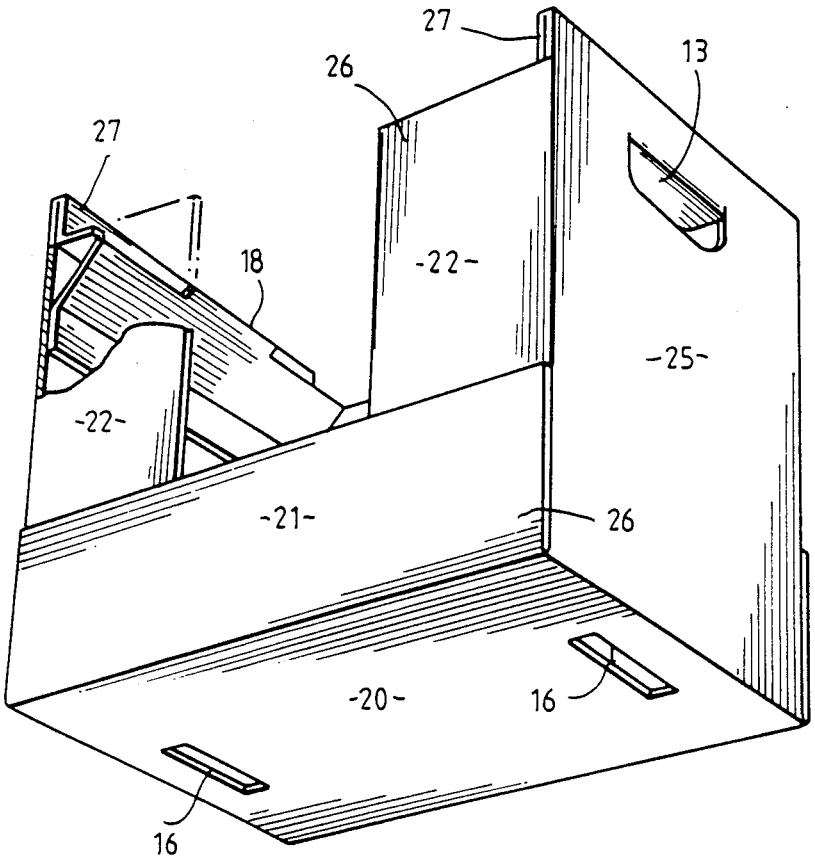
Figure 5:
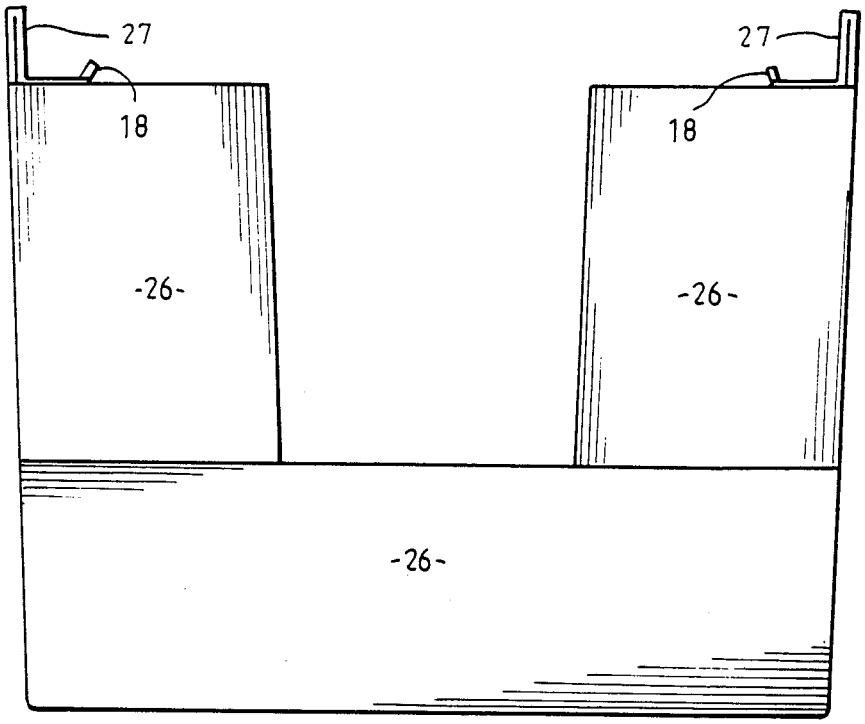
Figure 6:
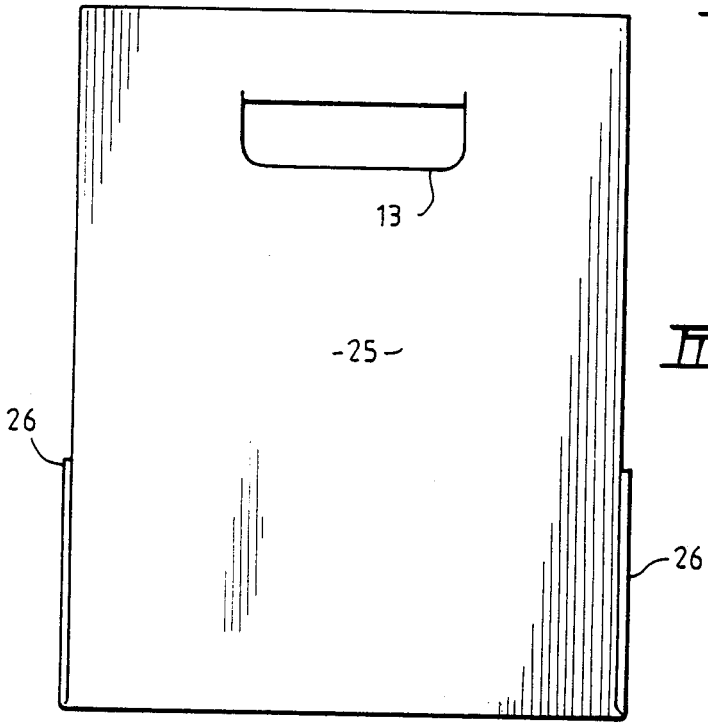
Figure 7:
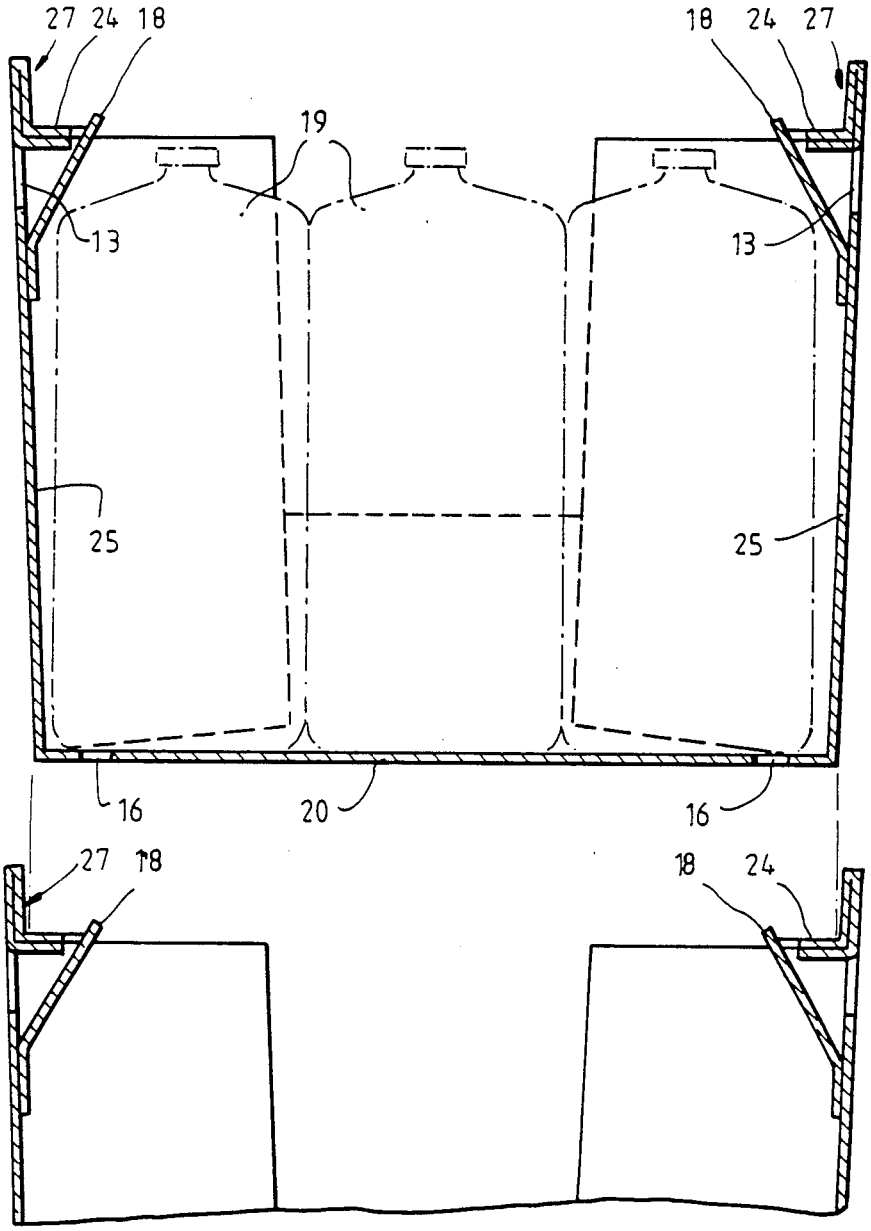
Figure 8:
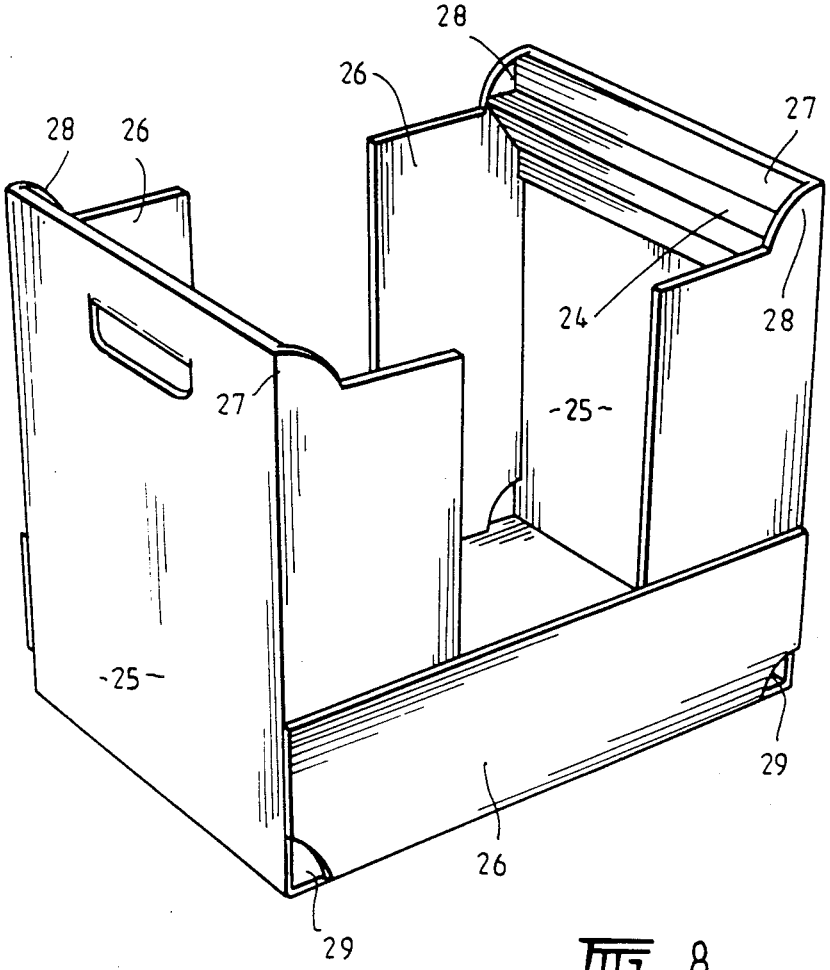

In order that the invention may be more readily understood one particular embodiment will now be described with reference to the accompanying drawings wherein:

FIG. 1 is a plan view of a crate blank for forming a crate according to the invention, FIG. 2 is a side elevation of the blank shown in FIG. 1, FIG. 3 is a perspective view from above of a crate formed from the blank of FIGS. 1 and 2, FIG. 4 is a perspective view from below of the crate formed from the blank of FIGS. 1 and 2, FIG. 5 is a side elevation of the crate, FIG. 6 is an end elevation of the crate, FIG. 7 is a sectional side elevation of the crate taken on the line 7—7 of FIG. 3 and shows liquid containers packaged in the crate as well as the relative positioning of the crate for stacking on top of a further similar crate.

The crate according to this embodiment is formed from corrugated cardboard which is cut to the shape shown in FIG. 1 and has a number of cuts and score lines formed thereon to facilitate folding of the crate into the shape shown in FIGS. 3–6. In FIG. 1 the broken lines represent score lines for folding of the crate and the continuous lines indicate cuts completely through the cardboard. The corrugations in the cardboard from which the blank is made are arranged to run in the longitudinal direction of the blank, that is, in the vertical direction on the page depicting FIG. 1, in order to maximize the strength of the formed crate. The score lines 10 facilitate folding of the blank to produce the four sides of the crate which is a generally rectangular box with open top. The score lines 11 in opposed extended ends 25*a* of the crate facilitate folding of the top portion of the opposed ends to provide additional strength and rigidity to the crate and to provide a shelf structure at each of the opposed ends as will become apparent hereinbelow. The cuts 12 also facilitate the initial folding of the blank into a box structure. The cuts 13 together with the score lines 14 enable handles to be provided in the opposed ends of the crate and the cuts 15 provide openings 16 in the base of the crate for purposes which will become apparent hereinbelow. Similarly the cuts 17 facilitate provision of upstanding tongues 18 for purposes which will become apparent.

Once the blank is formed and the appropriate cuts and score lines are made therein by means of a suitable die or otherwise, the blank is formed into the crate shown in FIGS. 3–7. The crate according to this embodiment is intended for use as a crate for plastic milk bottles which are shown schematically in FIG. 7 in the position they assume inside the crate. Similar capacity gable top paperboard cartons may also be accommodated in the exact same crate. The crate is designed to accommodate six such plastic milk bottles referenced 19 or gable top cartons (not shown) and, as is evident in FIG. 7, the six bottles 19 cannot be packaged into the crate as a unit when the crate is formed because the aforementioned shelf structure on the opposed ends of the crate causes the top opening in the longest dimension of the crate to be less than the overall dimension of three juxtaposed bottles 19. It is therefore necessary to use a procedure whereby the crate is formed around the contents and for this purpose a machine which does not constitute part of the present invention, is provided. According to the machine the six bottles are placed on the base portion 20 of the crate (after the extended ends 25*a* are folded and glued to provide the shelf structure) and the sides are folded around the bottles to ultimately provide a packaged crate. Of course the bottles 19 may be readily removed from the crate merely by first removing the centre bottle of either row of three bottles.

It should be mentioned that prior to folding the blank into the form of a crate glue is applied to various parts of the blank such that, when folded, the crate is permanently retained in the constructed state. For example, the flaps 22 of the blank are applied with glue so that they ultimately become permanently affixed to the respective flaps 21 to form the respective opposed sides of the crate. Also, prior to folding the extended ends 25*a* glue is applied to the blank adjacent the handles as is shown by reference 23 in FIG. 1. The glue 23 maintains the formed shelf structure at the opposed ends of the crate. After application of the glue 23 the first process is to fold the carton blank about the score lines 11 to provide an inwardly extending ledge 24 which is provided as part of the shelf structure which extends across the opposed ends 25 of the crate. The shelf structure is in the form of a triangular box structure or girder which is glued in position and contributes substantially to the rigidity of the crate and the ledge 24 provides a supporting structure for enabling a number of like crates to be stacked one on top of the other. In forming the triangular box structure the cuts 17 cause respective tongues 18 to project upwardly from the ledge 24.

When the triangular box structure is formed the crate blank is folded about the score lines 10 to complete construction of the crate whereby a completed and packaged crate is formed. The bottles 19 form a mandrel to hold the base 20 whilst the sides are folded into position. As mentioned previously the flaps 21 and 22 combine to provide respective opposed sides 26. It will be apparent from FIG. 1 that the flaps 21 and 22 are tapered in the sense that the cuts 12 are not exactly perpendicular to the parallel longitudinal edges of the blank and the effect of these tapered flaps is that the opposed ends 25 are inclined upwardly and outwardly away from each other slightly when the crate is formed. It will be further evident from the drawings that the opposed ends 25 extend to a height above the height of the opposed sides 26 and that the ledge 24 is arranged at a height very slightly above the height of the opposed sides 26. It will not be evident in the drawings that the width of the crate, that is, the distance between the sides 26, is less at the top of the crate than at the bottom. In other words, the dimension X in FIG. 3 is slightly less than the dimension Y such that opposed sides 26 of the crate taper upwardly and inwardly when viewed from the ends 25. This taper is not evident in the drawings because it is very slight (about 2°) and its purpose will become evident hereinbelow.

Referring now to FIG. 7 it is evident that when a packaged crate is placed on top of a further similar crate in the same orientation, the aforementioned upward and outward inclination of the opposed ends 25, allows the base of the upper crate to fit between the upward extensions 27 of the ends 25 such that the base of the upper crate bears on the respective ledges 24 of the crate immediately thereunder. Also, when one crate is placed on top of another the aforementioned upward and inward taper of the sides 26 ensures that the base 20 extends over the upper edges of the respective sides 26. Since the height of the ledge 24 is only very slightly above the upper edges of the sides 26 the weight of several packaged crates stacked one on top of the other causes the ledge 24 on the lower crates to deflect or "give" slightly due to the heavy weight thereon. As a consequence of this weight the base of one crate bears on the top edges of the sides 26 of the crate immediately therebelow. Since the corrugations of the flaps 22 of the sides 26 extend in a vertical direction they have considerable compressive strength and this contributes to the ability of the crate to support considerable weight thereon. In other words, the sides 26 assist the ledges 24 in supporting a stack of packaged crates when the weight is sufficient to cause the ledge 24 to deflect.

It will also be evident that when the crates are stacked the tongues 18 are located in respective openings 16 in the base of the crate stacked thereon. The net effect of the upward extensions 27 and the tongues 18 located in openings 16, is that sliding movement between the crates is prevented in both directions, that is, in the longitudinal and transverse directions of the crate when viewed in plan.

It will be evident from FIG. 7 that the packaged contents of the crate, that is, bottles 19 do not extend above the height of the opposed sides 26 and therefore the bottles 19 do not contribute to the stacking strength of the crate because the next crate above bears entirely on the ledge 24 and, after deflection, on the sides 26. This feature is desirable since the plastic milk bottles in question do not have any inherent stacking strength. It will be further evident that the crate is very efficient in packaging the bottles 19 since the overall length and width of the crate is only marginally greater than the overall length and width of the two parallel rows of bottles allowing only sufficient clearance for relative movement between the bottles to enable removal of a bottle. This latter feature is achieved despite the fact that the triangular box shaped beam or girder projects inwardly of the crate. This feature is possible because of the tapered top of the bottles, but necessitates forming the crate around the bottles rather than packaging the bottles into the crate, as a group, after the crate has been formed. Since the bottles are of generally rectangular shape rather than circular there is no possibility of having an upstanding support structure in the corners of the crate for the purpose of supporting the next crate thereabove.

Whilst the crate has been described in relation to its prime purpose of packaging containers of liquid such as milk or fruit juice which have no inherent stacking strength of their own and are thus termed "soft" goods it is clearly evident that the crate may be used for packaging other types of goods. The folded and glued horizontal triangular box structure or girder provides considerable strength to the crate particularly at the opposed ends 25 and this strength enables a considerable number of packaged crates to be stacked one on top of the other. The slightly tapered construction of the crate when viewed in side elevation enables the base of one crate to fit snugly between the upward extensions at the opposed ends of a crate immediately thereunder and thereby provides security to a stack of crates by preventing sliding movement therebetween in one direction. The tongue and groove type arrangement prevents horizontal sliding movement in a mutually perpendicular direction.

In the case where the crate of this invention is used for packaging milk containers for transport it is extremely economical when compared to existing plastic milk crates. The overall cost of the crate even considering that it is a disposable crate is considerably less than the overall cost of a reusable plastic crate when initial manufacture, collection, washing, handling and theft is taken into account. Whilst the shelf structure or girder is shown as an integral part of the opposed ends 25 it will be clear to persons skilled in the art that this structure could be manufactured separately and glued to the respective ends of the crate. The crate may of course be used to package plastic bags of milk as are now used to store milk in some specific instances. In this situation an additional opening (not shown) in a side of the crate may be provided to allow an outlet tap from the bag to pass through.

It should be further mentioned that the stacking strength of the present crate is achieved despite the fact that there is no separation of the various products by way of a wall or partition within the crate which is sometimes used in prior art crates to improve stacking strength.

Whilst one particular embodiment of the invention has been described herein it will be evident to persons skilled in the art that modifications may be readily effected without departing from the spirit and scope of the invention.

We claim:

1. A blank erectable into a crate, said blank including a first panel for forming a base of the crate and a plurality of further panels which extend from said first panel for folding to form generally upright peripheral walls of the crate, characterized in that, said further panels include an opposite pair of end wall panels providing end walls for the crate, and each end wall panel includes a first portion and an extended portion which is foldable relative to the first portion for forming a ledge which projects perpendicularly from said end wall to project inwardly of the crate and an extension distal to said first panel to form an upward extension of its respective end wall in the crate, said ledges being between said upward extensions and said first panel in order to lie below said upward extensions and provide support for the base of a like crate when stacked thereon, said end wall panels having means for inclining the end walls of the crate upwardly and outwardly slightly to allow the base of said like crate to fit between said upward extensions when said like crate is stacked thereon thus preventing relative horizontal sliding movement between the crates in a first direction, and said end wall panels have a width dimension at an end distal to the first panel which is less than the width dimension of said end wall panels at an end adjacent to said first panel, whereby said crate is tapered inwardly and upwardly slightly when viewed from an end, whereby said base of said like crate overlies the upper edges of the other said peripheral walls of the crate immediately therebelow when said crates are stacked such that the other said peripheral walls provide support to the crate above, when said ledge is caused to deflect due to the weight thereon.

2. A blank according to claim 1, formed of corrugated cardboard, characterized in that, cuts are made through said blank on said extended portions whereby upstanding tongues (18) are formed of the respective ledges when said blank is erected, and openings (16) are provided is said base (20) in a position wherein said tongues (18) of one crate engage in respect of said openings (16) in another crate which is stacked thereon thus preventing relative horizontal sliding movement in a second direction perpendicular to said first direction.

3. A blank according to claim 2, characterized in that, further cuts (13) are provided in said blank, said further cuts being provided in said opposite pair (25) of further panels to provide handle openings in the erected crate.

4. A blank according to claim 1, wherein said first portions of said end wall panels are foldable to provide said ledges at a height slightly above the height of the other said peripheral walls in the crate.

5. The blank of claim 1, wherein each said end wall panel has a juncture with said first panel lying along a straight line, and said means for inclining the end walls of the crate upwardly and outwardly slightly comprises a portion of each said end wall panel which extends beyond the adjacent straight line toward said first panel.

6. A blank according to claim 4, characterized in that, said extended portions are foldable back onto the respective panels on which they are included to form said girder including said ledge, and are adapted for gluing to said panel to remain in the folded condition, and said girder is of triangular section.

7. A disposable crate for packaging goods for transport and storage, said crate being a generally rectangular box having a base, peripheral walls and an open top, characterized in that, the peripheral walls include a first pair of opposed walls and other walls defining a height and upper edges, said opposed walls comprising end walls each having an inside, an upward extension extending above the height of the outer walls, and a girder arranged on the inside of each of said end walls, said girder including a horizontal ledge arranged at a height above the height of said other walls to provide support for the base of a like crate when stacked thereon, said end walls extending upwardly and outwardly slightly to allow the base of said wall crate to fit between said upward extensions when a like crate is stacked thereon thus preventing relative horizontal sliding movement between the crates in a first direction, and said end walls having a width dimension at the top which is less than the width dimension at the base thereof, whereby said crate is tapered inwardly and upwardly slightly when viewed from an end, whereby said base of said like crate overlies the upper edges of the other said peripheral walls of the crate immediately therebelow when said cratesa are stacked such that the other said peripheral walls provide support to the crate above, when said ledge is caused to deflect due to the weight thereon.

8. A crate according to claim 7, wherein each said girder is integral with its end wall, each said upward extension and each said girder comprising a portion of said end wall folded back on itself, each folded back portion being glued to the remainder of its end wall.

9. A crate according to claim 7, wherein the crate comprises corrugated cardboard on solid fiberboard, and each said girder has a triangular section, each horizontal ledge including an upstanding tongue, and said base of said crate has openings in a position wherein said tongues of one crate engage in respective openings of another crate which is stacked thereon, thus preventing relative horizontal sliding movement in a second direction perpendicular to said first direction.

10. A crate according to claim 9, wherein said first pair of opposed sides has handle openings adjacent the tops thereof.

11. A method for packaging containers using a blank having a first panel for forming a base of crate and a plurality of further panels which extend from said first panel for folding to form generally upright peripheral walls of the crate, said further panels including an opposite pair of end wall panels providing end walls for the crate, and each end wall panel including a first portion and an extended portion which is foldable relative to the first portion for forming a ledge which projects perpendicularly form said end wall to project inwardly of the crate and an extension distal to said first panel to form an upward extension of its respective end wall in the crate, said ledges being between said upward extensions and said first panel in order to lie below said upward extensions and provide support for the base of a like crate when stacked thereon, said end wall panels having means for inclining the end walls of the crate upwardly and outwardly slightly to allow the base of said like crate to fit between said upward extensions when said like crate is stacked thereon thus preventing relative horizontal sliding movement between the crates in a first direction, and said end wall panels having a width dimension at an end distal to the first panel which is less than the width dimension of said end wall panels at an end adjacent to said first panel, whereby said crate is tapered inwardly and upwardly slightly when viewed form an end, whereby said base of said like crate overlies the upper edges of the other said peripheral wall of the crate immediately therebelow when said crates are stacked such that the other said peripheral walls provide support to the crate above, when said ledge is caused to deflect due to the weight thereon, comprising:

forming the crate around the containers, wherein the containers are used as a mandrel in the forming process.

* * * * *